United States Patent [19]

Desmond

[11] Patent Number: 5,022,682

[45] Date of Patent: Jun. 11, 1991

[54] BOOK WITH TRANSPARENT PAGES WITH MIRRORED IMAGES ON FRONT AND BACK

[76] Inventor: Betsy J. Desmond, 39 Bartlett St., Apt. 5, Beverly Farms, Mass. 01915

[21] Appl. No.: 587,986

[22] Filed: Sep. 25, 1990

[51] Int. Cl.[5] ..... B42D 5/00

[52] U.S. Cl. ..... 281/38; 281/15.1; 283/63.1

[58] Field of Search ..... 281/38, 15.1; 283/34, 283/35, 63.1; 40/394, 492, 530, 587, 612, 600; 434/85, 86, 150, 151, 153, 178

[56] References Cited

U.S. PATENT DOCUMENTS

| | | | |
|---|---|---|---|
| 740,280 | 9/1903 | Ikemori | 283/34 |
| 903,531 | 11/1908 | Aberie | 283/34 |
| 1,039,322 | 9/1912 | Rindall | 283/34 |
| 1,510,110 | 9/1924 | Schmidt | 434/150 |
| 2,075,529 | 3/1937 | Leubrie | 281/38 |
| 2,232,033 | 2/1941 | Krones | 281/15.1 |
| 2,316,786 | 4/1943 | Gottlieb | 434/150 |
| 3,492,743 | 2/1970 | Schmidt | 281/38 |
| 3,518,782 | 7/1970 | Long | 40/588 |

*Primary Examiner*—Douglas D. Watts
*Assistant Examiner*—Hwei-Siu Payer
*Attorney, Agent, or Firm*—Hale and Dorr

[57] ABSTRACT

Disclosed is a book which includes one or more transparent sheets inserted between the pages of opaque stock. The transparent sheets have images painted, drawn, or otherwise reproduced on both sides of the transparent sheet. The images are mirrored in size and shape from front to back of the transparent sheet affording the viewer one basic image that has two different views. The present invention, when seen as a page in a book, allows illustrations or text, on opaque pages, to be altered without losing sight of the original pages.

5 Claims, 1 Drawing Sheet

BOOK WITH TRANSPARENT PAGES WITH MIRRORED IMAGES ON FRONT AND BACK

BACKGROUND OF THE INVENTION

The present invention relates to a book, and more specifically to a picture book including transparent pages that enable the changing of the images found on both facing adjacent pages of each transparent page.

Picture books commonly sold today illustrate text that is printed on opaque stock. Some books go beyond the usual flat papers and include holes, fold-outs or movable parts. In all such instances, the action changes by turning the opaque pages, and what was seen before is lost when covered by the next leaf.

These picture books have proven interesting and creative, however, there is significant demand for more technically advanced reading materials that provide significant stimulation for readers, especially children.

The principal object of the present invention is to provide an illustrated book in which the appearance of printed images can be changed.

It is another object of the present invention to provide a book in which images on a page can be temporarily hidden or covered up.

SUMMARY OF THE INVENTION

The present invention is a book which includes one or more transparent sheets inserted between the pages of opaque stock. The transparent sheets have images painted, drawn, or otherwise reproduced on both sides of the transparent sheet. The images are mirrored in size and shape from front to back of the transparent sheet affording the viewer one basic image that has two different views. The present invention, when seen as a page in a book, allows illustrations or text, on opaque pages, to be altered without losing sight of the original pages.

These and other features and objects of the present invention will be more fully understood from the following detailed description which should be read in light of the accompanying drawings in which corresponding reference numerals refer to corresponding parts throughout the several views. Although the drawings depict specific images of a hat and frog, these are not to be considered the only possible images. For the purpose of this application, they were chosen as only examples of potential illustrations of the present invention.

DETAILED DESCRIPTION OF THE PREFERRED EMBODIMENTS

Figure 1:
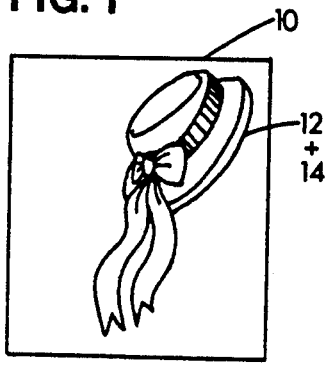
FIG. 1 is a representation of a sample transparent page with pictures on both sides of the page of a book of the present invention.

Referring to FIG. 1, the clear transparent page 10 of the book of the present invention includes one sheet of transparent material which in a preferred embodiment is acetate. The sheet 10 includes images 12 and 14 reproduced on both sides of the sheet. The images 12 and 14 are mirror images of each other in size and shape, reproduced in the same place on both sides of the transparent sheet 10. Therefore, when viewed from one side of the transparent sheet 10, only one image is seen. The illustrations present in FIGS. 2 and 3 of the hat 12 and the frog 14 are examples of images, but are not meant to be the only possible illustrations.

Figure 2:
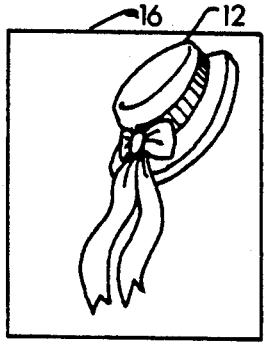
FIG. 2 is a front view of the transparent page shown in FIG. 1.
Figure 3:
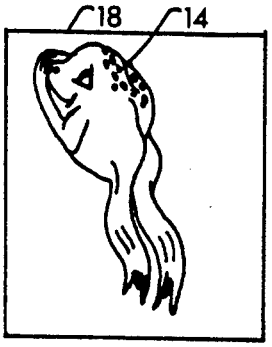
FIG. 3 is a rear view of the transparent page shown in FIG. 1.

Referring to FIG. 2, the front 16 of sheet 10 is shown with an image 12 reproduced thereon. When the page 10 if flipped, as shown in FIG. 3, the back 18 view of page 10 is seen. Here the second image 14 which is the mirrored shape and size of image 12 is revealed.

Referring to FIGS. 4–7, the relationship of the transparent page 10 to the opaque pages is shown in a book 20 showing the left page 22 of the book 20, and its right page 24. Both pages 22 and 24 are of the usual opaque stock of a book 20 of consistent size while transparent page 10 is of a slightly smaller size. The size difference insures that when the opaque page is turned, the transparent page 10 initially remains on the right hand side of the book 20 to follow proper reading habits, that is, page turn from right to left.

Figure 4:
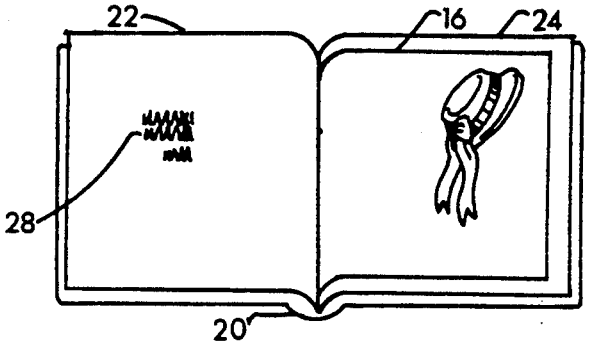
FIG. 4 through FIG. 7 are sequence drawings showing the use of the transparent sheets in a book of the present invention.
Figure 5:
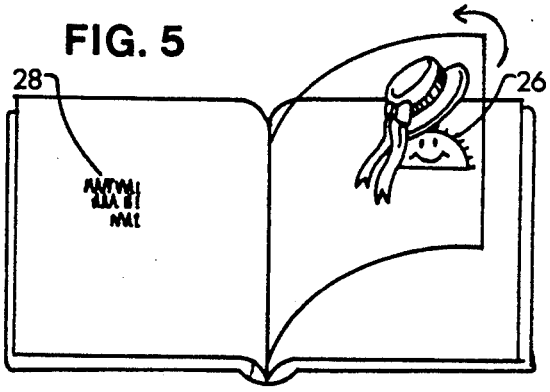
Figure 6:
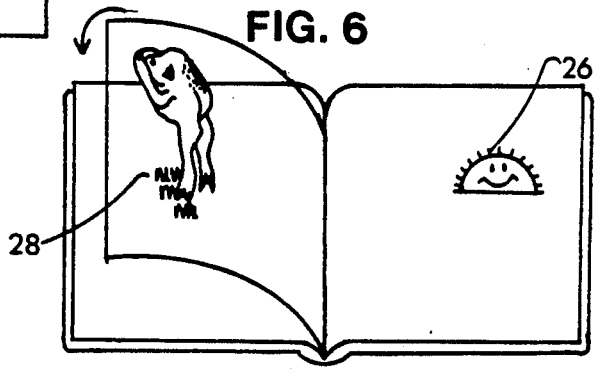
Figure 7:
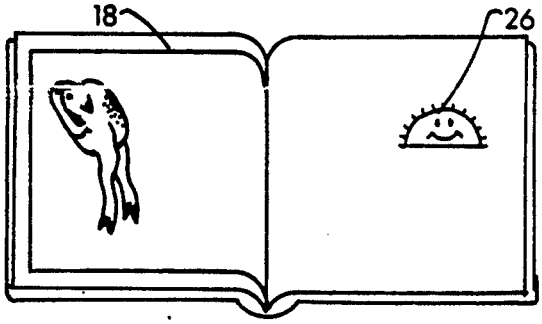

In FIG. 4, the transparent page 10 is first seen on the right hand side of the book 20 and the front 16 of the transparent page 10 is seen. The reader then turns the transparent page 10 from right to left, as shown in FIGS. 5 and 6, to reveal the back side 18 of the present invention 10 and the new image 14 which is shown in FIG. 7.

FIGS. 4 through 7 further demonstrate that the images 12 and 14 of the present invention 10 may cover-up and/or reveal illustrations 26 and/or text 28 printed on the opaque pages of the book 20.

While the foregoing invention has been described with reference to its preferred embodiments, various alterations and modifications will occur to those skilled in the art. All such alterations and modifications are intended to fall within the scope of the appended claims.

What is claimed is:

1. An illustrated book comprising:

a plurality of opaque sheets with illustrations thereon;

at least one transparent sheet positioned between two of said plurality of opaque sheets, said transparent sheet including illustrations on each face of said transparent sheet, said illustration on a front face of said transparent sheet being of a size and shape that is in register with the size and shape of said illustration on a rear face of said transparent sheet.

2. The illustrated book of claim 1 wherein height and width of said transparent sheet are less than the height and width of the opaque sheet adjacent said front face of said transparent sheet.

3. The illustrated book of claim 1 wherein said illustration on said front face of said transparent sheet is different from said illustration on said rear face of said transparent sheet.

4. The illustrated book of claim 1 wherein said illustration on said transparent sheet covers over an illustration on an opaque sheet when said transparent sheet lies over said opaque sheet.

5. The illustrated book of claim 1 wherein said illustration on said transparent sheet covers over text on an opaque sheet when said transparent sheet lies over said opaque sheet.

* * * * *